United States Patent [19]

Murray et al.

[11] 4,095,580

[45] Jun. 20, 1978

[54] PULSE-ACTUATED FUEL-INJECTION SPARK PLUG

[75] Inventors: Ian Murray; Clement A. Tatro, both of Livermore, Calif.

[73] Assignee: The United States of America as represented by the United States Department of Energy, Washington, D.C.

[21] Appl. No.: 734,918

[22] Filed: Oct. 22, 1976

[51] Int. Cl.[2] ..... F02D 3/00

[52] U.S. Cl. ..... 123/32 SJ; 123/32 JV; 123/32 AE

[58] Field of Search ..... 123/32 AE, 32 AB, 32 SJ, 123/139 E

[56] References Cited

U.S. PATENT DOCUMENTS

| | | | |
|---|---|---|---|
| 2,795,214 | 6/1957 | Shook | 123/32 SJ |
| 3,418,980 | 12/1968 | Benson | 123/32 AB |
| 3,926,169 | 12/1975 | Leshner et al. | 123/32 SJ |
| 3,980,061 | 9/1976 | McAlister | 123/32 AB |

*Primary Examiner*—Ronald B. Cox
*Attorney, Agent, or Firm*—Dean E. Carlson; Roger S. Gaither; Clifton E. Clouse, Jr.

[57] ABSTRACT

A replacement spark plug for reciprocating internal combustion engines that functions as a fuel injector and as a spark plug to provide a "stratified-charge" effect. The conventional carburetor is retained to supply the main fuel-air mixture which may be very lean because of the stratified charge. The replacement plug includes a cylindrical piezoelectric ceramic which contracts to act as a pump whenever an ignition pulse is applied to a central rod through the ceramic. The rod is hollow at its upper end for receiving fuel, it is tapered along its lower length to act as a pump, and it is flattened at its lower end to act as a valve for fuel injection from the pump into the cylinder. The rod also acts as the center electrode of the plug, with the spark jumping from the plug base to the lower end of the rod to thereby provide spark ignition that has inherent proper timing with the fuel injection.

6 Claims, 2 Drawing Figures

PULSE-ACTUATED FUEL-INJECTION SPARK PLUG

The invention disclosed herein was made under, or in, the course of Contract No. W-7405-ENG-48 with the United States Energy Research and Development Administration.

BACKGROUND OF THE INVENTION:

The invention relates to a combined spark plug and fuel injection pump and more particularly it relates to a plug that is responsive directly and solely to an ignition pulse to inject fuel and provide a spark.

Certain exhaust emissions from internal combustion engines are of acute environmental concern. The emissions that are of primary concern include hydrocarbons, carbon monoxide, and nitrogen oxides. One successful approach to the reduction of such exhaust emissions is the "stratified charge" concept which has resulted in engines such as disclosed in U.S. Pat. No. 3,830,205, issued to Date and Yagi on Aug. 20, 1974. In such engines, a small volume of fuelrich mixture is supplied to a small auxiliary chamber adjacent the main combustion chamber. A spark plug is located in the small chamber and because of the richness of the fuel in the chamber, the fuel is easily ignited by the plug. A fuel-lean mixture is supplied to the main chamber which is ignited by the burning fuel in the small chamber. This arrangement results in the use of a very lean fuel mixture to the main chamber, low combustion temperatures in the main chamber, high combustion temperatures in the small chamber, long combustion times in both the small and main chamber, and complete combustion in both chambers. These conditions meet the often conflicting conditions for the reduction of hydrocarbons, carbon monoxide, and nitrogen oxides. However, the requirement for these engines of an auxiliary combustion chamber, additional valving, and additional fuel and air passages virtually precludes the retrofitting of existing internal combustion engines for stratified-charge operation. Moreover, the redesign and retooling required for existing manufactures to mass produce such engine would be a very costly and time consuming conversion.

SUMMARY OF THE INVENTION

In brief the invention is a spark plug that is responsive to an ignition pulse for injecting fuel into the combustion chamber of a reciprocating internal combustion engine and for igniting the injected fuel. The plug includes means for receiving an ignition pulse, means for receiving a supply of fuel, and means responsive solely to an ignition pulse applied to the pulse receiving means for injecting fuel from the fuel receiving means into the combustion chamber for igniting the injected fuel.

It is an object of the invention to operate conventional internal combustion engines in the stratified charge mode.

Another object is to retrofit conventional internal combustion engines to operate in the stratified charge mode with minimal modification and expense.

Another object is to provide a spark plug that is directly responsive solely to an ignition pulse to develop a spark across a pair of electrodes and to inject fuel in the space adjacent the electrodes.

Other objects and advantageous features of the invention will be apparent in a description of a specific embodiment thereof, given by way of example only, to enable one skilled in the art to readily practice the invention which is described hereinafter with reference to the accompanying drawing.

DESCRIPTION OF AN EMBODIMENT

Figure 1:
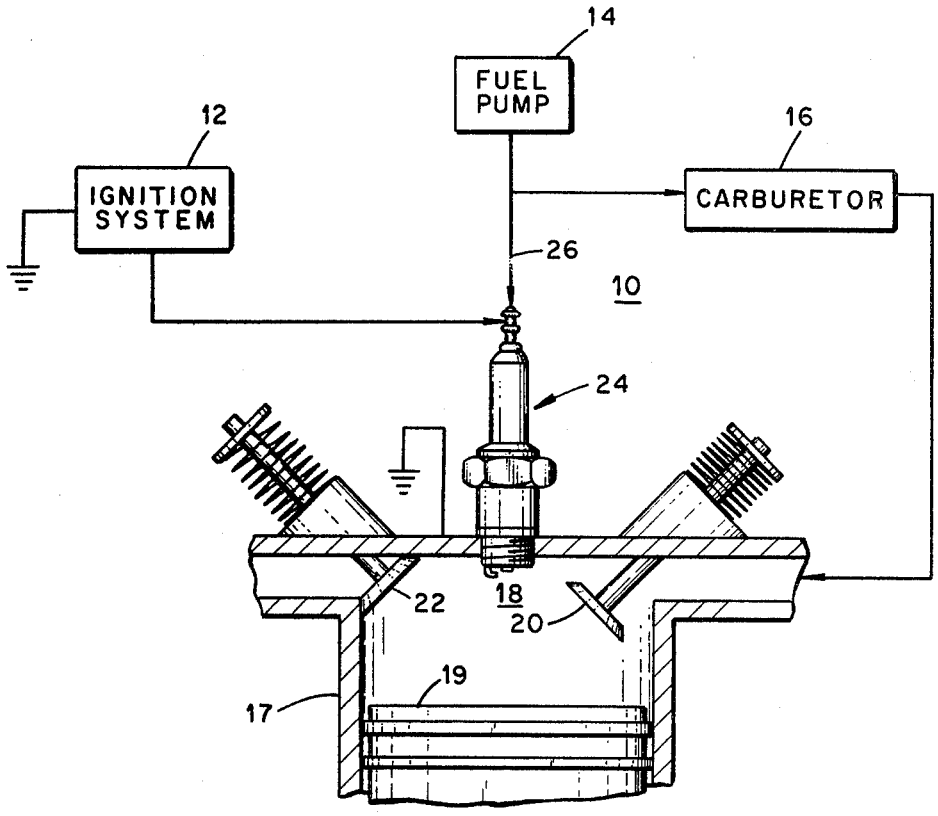
FIG. 1 is a schematic diagram of a reciprocating internal combustion engine system according to the invention.

Referring to the drawing there is shown in FIG. 1 a four-cycle reciprocating internal combustion engine system 10 including an ignition system 12, a fuel pump 14, a carburetor 16, a cylinder 17 with a combustion chamber 18, a piston 19, an intake valve 20, an exhaust valve 22, all conventional, and a fuel-injection spark plug 24 according to the invention.

In general, the engine system 10 operates conventionally, the modifications to the conventional system being the provision of the spark plug 24, a fuel line connection 26 between the fuel pump 14 and the plug 24, and a change in carburetor jets to provide a lean fuel mixture from the carburetor to the combustion chamber 18. These simple modifications enable the engine system 10 to be operated in the stratified-charge mode whereby the spark plug 24 is responsive solely to a pulse from the ignition system 12 to inject a small amount of fuel into the upper part of the combustion chamber 18 and to easily and simultaneously ignite this rich fuel mixture which in turn ignites the lean fuel mixture in the remainder of the chamber 18.

Figure 2:
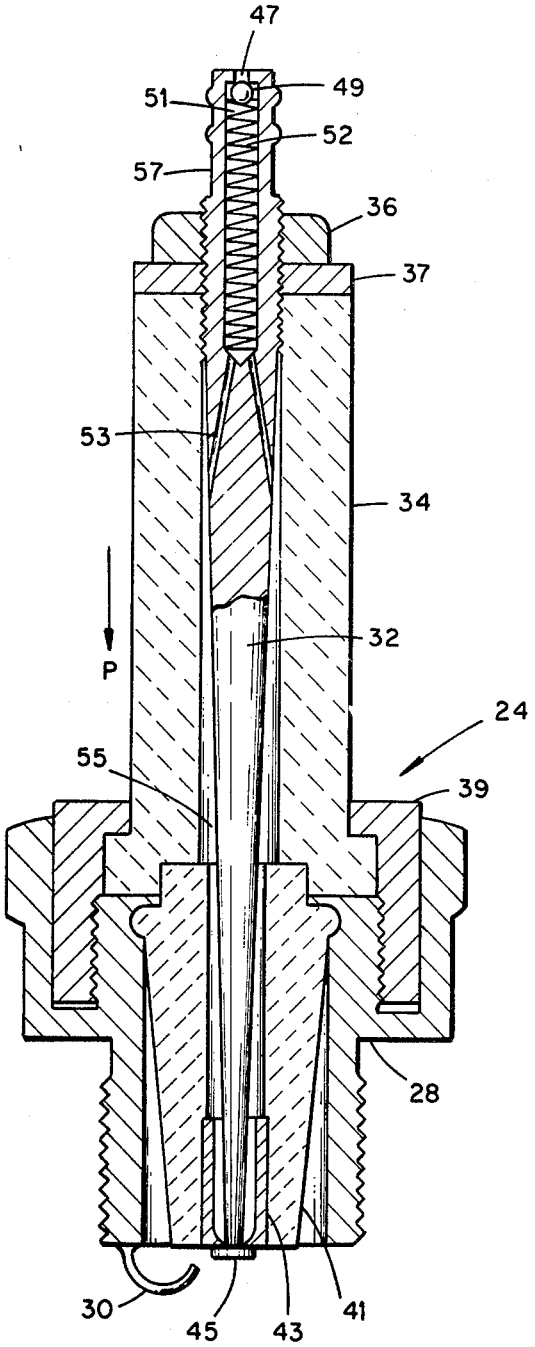
FIG. 2 is a cross-sectional diagram of a spark plug in the engine system of FIG. 1 for injecting and igniting fuel for stratified charge mode of operation of the engine system.

Referring to FIG. 2, the spark plug 24 is shown in detail in cross section and comprises a base 28 that includes a ground electrode 30, a center electrode 32 mounted within a cylinder 34 of piezoelectric material such as a polarized ceramic (for example lead zirconate titanate) by means of threads at the upper end that are mated with threads in the upper end of the cylinder 34, a nut 36 and washer 37 for locking the electrode 32 and cylinder 34 together and for providing good electrical contact between the electrode 32 and the piezoelectric cylinder 34. The cylinder 34 is held to the base 28 by means of a threaded collar 39, and a ceramic insulator 41 is secured to the base 28 to extend from the cylinder 34 to the lower end of the electrode 32. A metal insert 43 is provided in the lower tip of the insulator 41 for sealing engagement with an enlarged end 45 of the electrode 32. At the upper end of the electrode 32 an opening 47 is provided for receiving fuel under pressure from the fuel pump 14 into the spark plug 24. A ball valve 49 is provided within a central passage 51 in the electrode 32 and is spring loaded towards the opening 47 by means of a spring 50 to ensure that fuel does not flow back towards the fuel pump 14. Inner fuel passages 53 connect the central passage 51 with a fuel storage chamber 55 defined by a central cylindrical passage in the piezoelectric cylinder 34 and the insulator 41. The electrode 32 is tapered from its upper end to the lower end to complete the definition of the chamber 55.

In operation of the fuel-injection spark plug 24 there is a continuous fuel pressure from the fuel pump 14 through the opening 47 to ensure that the fuel chamber 55 is filled with fuel at all times. An exposed surface area 57 is provided at the upper end of the electrode 32 for receiving an ignition pulse from the ignition system 12. Upon application of an ignition pulse between the area 57 and the base 28, which is threaded for mounting in the grounded cylinder 17, the piezoelectric cylinder 34, which is constructed to have its axis of polarization in the longitudinal direction P, contracts very rapidly in the longitudinal direction. The contraction of the cylinder 34 is so rapid that the rod 32 cannot move instantaneously with the cylinder 34. The rod 32 therefore compresses and the end 45 remains temporarily in sealing engagement with the insert 43. A very large force is thereby applied over the tapered surface area of the electrode 32 in a longitudinal direction to the fuel within the chamber 55. Upon eventual elongation of the electrode 32 the enlarged end 45 is moved away from the insert 43 and the fuel is injected from the chamber 55 under high pressure into the combustion chamber 18, creating a fuel-rich vapor in the upper portion of the chamber 18. Substantially simultaneously with the fuel injection the pulse applied between the electrodes 30 and 32 builds to the voltage breakdown point of the vapor between the electrodes, causing current flow between the electrodes and ignition of the fuel-rich vapor. The fuel injection and its ignition thereby occur inherently at the precisely correct time with respect to each other and at the precisely correct time in the engine cycle with only the simple modifications to a conventional engine system that have been described.

While an embodiment of the invention has been shown and described, further embodiments or combinations of the invention will be apparent to those skilled in the art without departing from the spirit of the invention. As one example, the spark plug 24 may be adapted with the same ease to a two-cycle engine system as has been adapted to the four-cycle system 10 that has been described.

What we claim is:

1. A spark plug responsive to an ignition pulse for injecting fuel into the combustion chamber of a reciprocating internal combustion engine and for igniting the injected fuel, including:

fuel storage means;

means for receiving fuel for passage to said storage means;

means for receiving an ignition pulse; and means responsive solely to an ignition pulse applied to said pulse receiving means for injecting fuel from said fuel storage means into the combustion chamber and for igniting the injected fuel, said responsive means comprising:

first and second electrodes;

a piezoelectric material electrically connected between said electrodes and defining with said first electrode said storage means; and means for normally blocking the flow of fuel from said storage means, said piezoelectric material being responsive to a pulse applied across said electrodes to deform and thereby cause a pressure buildup in said storage means and to cause said blocking means to open for injection of the fuel in said storage means into the combustion chamber, and said first electrode being centrally located within said storage means and having an upper end as an element of said fuel receiving means and a lower end as an element of said blocking means.

2. A spark plug as defined in claim 1, wherein said fuel storage means is a cylindrical fuel chamber and said first electrode is a rod mounted within said fuel chamber with the axis of the rod coaxial with the axis of the fuel chamber, said rod being secured at its fuel receiving end to said piezoelectric material and having an enlarged end at its opposite end as an element of said blocking means, said enlarged end normally sealing the lower end of said fuel chamber, said rod being responsive to said deformation of said piezoelectric material to move said enlarged end away from the lower end of said fuel chamber to permit the injection of fuel into the combustion chamber.

3. A spark plug as defined in claim 2, wherein said rod is tapered from its upper end to its lower end to maximize the pressure applied to the fuel in said fuel chamber upon deformation of said piezoelectric material.

4. A spark plug as defined in claim 1, for use in a reciprocating internal combustion engine system for operation in a stratified charge mode, said system including:

a combustion chamber including an intake valve, said spark plug extending into said chamber;

a carburetor adjusted to provide a lean air-fuel mixture through said intake valve to said combustion chamber;

a source of ignition pulses connected to said spark plug; and means for supplying fuel to said spark plug, said plug being operable in response solely to a pulse from said source to inject supplied fuel into said chamber and to ignite the injected fuel to burn and ignite the lean air-fuel mixture in the remainder of the chamber and thereby establish a stratified charge mode of operation for the engine system.

5. The spark plug and internal combustion engine system as defined in claim 4, wherein said spark plug further includes:

a fuel inlet valve connected to said fuel supplying means for preventing fuel backflow from said storage means to said fuel supplying means.

6. The spark plug and internal combustion engine system as defined in claim 4 wherein said fuel storage means is a cylindrical fuel storage chamber;

said first electrode is a tapered rod mounted in said fuel storage chamber coaxially with said fuel storage chamber; and said responsive means is responsive to a pulse from said source for moving said rod axially within said fuel storage chamber to maximize the fuel pressure within said fuel storage chamber for injection of fuel therefrom into said combustion chamber.

* * * * *